US009914895B2

(12) United States Patent
Greaves et al.

(10) Patent No.: US 9,914,895 B2
(45) Date of Patent: Mar. 13, 2018

(54) OIL SOLUBLE POLYOXYBUTYLENE POLYMERS AS FRICTION MODIFIERS FOR LUBRICANTS

(71) Applicant: Dow Global Technologies LLC, Midland, MI (US)

(72) Inventors: Martin R. Greaves, Baar (CH); Evelyn A. Zaugg-Hoozemans, Horgen (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 14/774,985

(22) PCT Filed: May 13, 2014

(86) PCT No.: PCT/US2014/037806

§ 371 (c)(1),
(2) Date: Sep. 11, 2015

(87) PCT Pub. No.: WO2014/189712

PCT Pub. Date: Nov. 27, 2014

(65) Prior Publication Data

US 2016/0068780 A1 Mar. 10, 2016

Related U.S. Application Data

(60) Provisional application No. 61/826,537, filed on May 23, 2013.

(51) Int. Cl.
*C10M 145/32* (2006.01)
*C10M 145/36* (2006.01)

(52) U.S. Cl.
CPC ..... *C10M 145/32* (2013.01); *C10M 145/36* (2013.01); *C10M 2203/1025* (2013.01); *C10M 2205/0285* (2013.01); *C10M 2207/2805* (2013.01); *C10M 2207/2825* (2013.01); *C10M 2207/2835* (2013.01); *C10M 2209/105* (2013.01); *C10M 2209/106* (2013.01); *C10N 2230/06* (2013.01)

(58) Field of Classification Search
CPC ..... C10M 145/32; C10M 145/36; C10M 2207/2805; C10M 2205/0285; C10M 2207/2825; C10M 2209/105; C10M 2209/106; C10M 2203/1025; C10M 2207/2835; C10N 2230/06
See application file for complete search history.

(56) References Cited

U.S. PATENT DOCUMENTS 5,198,135 A * 3/1993 Galic ..... C10M 145/32 508/398
6,444,627 B1 * 9/2002 Berchtold ..... C10M 169/04 252/77
2011/0098492 A1 4/2011 Varineau et al.

FOREIGN PATENT DOCUMENTS

EP 0438709 7/1991
WO WO-0023648 A1 * 4/2000 ..... C10M 169/04
(Continued)

*Primary Examiner* — Taiwo Oladapo
(74) *Attorney, Agent, or Firm* — Brooks, Cameron & Huebsch, PLLC

(57) ABSTRACT

Provided are lubricant compositions comprising a hydrocarbon base oil and a polyoxybutylene polymer prepared by polymerizing butylene oxide with a monol initiator and having a number average molecular weight ranging from 800 g/mol to 1200 g/mol. The polyoxybutylene polymer functions as a highly active friction-modifier additive.

5 Claims, 1 Drawing Sheet

(56) References Cited

FOREIGN PATENT DOCUMENTS

| | | |
|---|---|---|
| WO | 2011011656 | 1/2011 |
| WO | 2013062682 | 5/2013 |

* cited by examiner

OIL SOLUBLE POLYOXYBUTYLENE POLYMERS AS FRICTION MODIFIERS FOR LUBRICANTS

FIELD

This invention relates generally to a lubricant composition. More specifically, the invention relates to a lubricant composition containing a base oil and a polyoxybutylene polymer as a friction-modifier additive, wherein the polyoxybutylene polymer and the base oil are soluble in one another.

BACKGROUND

Increasing interest in developing lubricants that provide low friction and which are energy efficient in equipment for both the automotive and industrial lubricants industries is a macro trend across the lubricant industry today. One important way to reduce friction is to use friction-modifier additives in lubricant compositions. There has been considerable research carried out to explore the performance and mechanisms of action of friction-modifying additives across the lubricant industry. During this time, tribological tools for studying surfaces have greatly enhanced our understanding of how additives perform. Researchers have shown that friction can be reduced in boundary lubricating conditions by adsorbing or reacting additives on metal surfaces to form thin low-shear-strength films. Furthermore some of these additives can have a significant effect on friction in the mixed lubrication regime.

Two examples of friction-modifying additive chemistries are organic friction modifiers and organo-molybdenum compounds. The former are usually long-chain polar compounds based on carboxylic acid, amine, ester and alcohol groups. Examples include glycerol mono-oleate, oleylamide, stearic acid and trimethyolpropane esters. These tend to function through their polar heads absorbing on to surfaces with the lipophilic tail aligned perpendicular to the surface. There are some practical challenge in using these materials in lubricant compositions. For example esters are prone to hydrolysis if there is ingress of water into the lubricant. Amine containing materials are known to cause elastomer incompatibility issues. Amides, such as oleylamide, are known to have a high degree of surfactancy character and can lead to emulsion formation. Carboxylic acids can react with metals to form carboxylate salts that are sometimes not desired.

When formulating lubricants, it is highly desirable that all additives, including friction-modifiers, be soluble in the composition. Such solubility is preferably maintained across a wide range of temperature and other conditions in order to enable shipping, storage, and/or prolonged use of these compositions.

Lubricant additives that provide significant friction modification benefits without the disadvantages of current additives, such as hydrolytic instability, and that are also readily soluble in the lubricant base oil would be highly beneficial to the lubricant industry.

STATEMENT OF INVENTION

We have now found that polyoxybutylene polymers as described herein function as excellent friction modifier additives for lubricants. In particular, it has been found that selection of polyoxybutylene polymers having a number average molecular weight ranging from 800 to 1200 g/mol and prepared from a monol initiator, as herein described, significantly outperform similar materials that are otherwise of lower or higher molecular weight or that are prepared from a non-monol initiator. Advantageously the polyoxybutylene polymers are also soluble in hydrocarbon base oils.

Moreover, the inventive materials outperform conventional ester based friction modifiers and provide the added benefit of having greater hydrolytic stability over the esters, thus making them more tolerant of water that may be present in lubricant compositions.

In one aspect, therefore, there is provided a lubricant composition comprising: a hydrocarbon base oil; and a friction modifier comprising a polyoxybutylene polymer, the polyoxybutylene polymer having been prepared by polymerizing butylene oxide with a monol initiator, and having a number average molecular weight ranging from 800 g/mol to 1200 g/mol, the hydrocarbon base oil and the polyoxybutylene polymer being soluble with one another.

In another aspect, there is provided a method for reducing friction between lubricated surfaces, the method comprising: lubricating a surface with the lubricant composition as described herein, wherein friction is reduced relative to a composition free of the polyoxybutylene polymer.

In a further aspect, there is provided a method of lubricating a mechanical device, the method comprising using the lubricant composition as described herein to lubricate the mechanical device.

DETAILED DESCRIPTION

Figure 1:
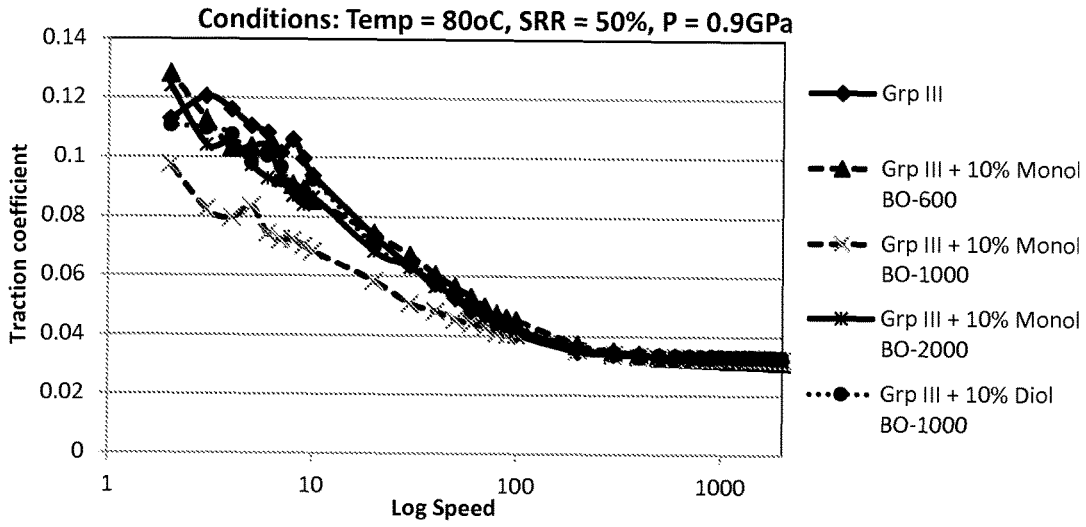
FIG. 1 shows friction profiles for various comparative and inventive polymers in a representative mineral hydrocarbon base oil (NEXBASE™ 3080).

Unless otherwise indicated, numeric ranges, for instance as in "from 2 to 10," are inclusive of the numbers defining the range (e.g., 2 and 10).

Unless otherwise indicated, ratios, percentages, parts, and the like are by weight. Unless otherwise indicated, the phrase "molecular weight" refers to the number average molecular weight as measured in a conventional manner.

"Propyleneoxy" or "PO" as used herein refers to $—CH_2—CH(CH_3)—O—$ or $—CH(CH_3)—CH_2—O—$, and "butyleneoxy" or "BO" refers to $—CH_2—CH(CH_2CH_3)—O—$ or $—CH(CH_2CH_3)—CH_2—O—$. "Alkyl" encompasses straight and branched chain aliphatic groups having the indicated number of carbon atoms.

The invention provides lubricant compositions comprising a hydrocarbon base oil and a polyoxybutylene polymer as a friction modifier and methods for its use. Advantageously, the hydrocarbon base oil and the polyoxybutylene polymer are soluble in each other.

Hydrocarbon base oils useful in the composition of the invention include the hydrocarbon base oils designated by the American Petroleum Institute as falling into Group I, II, III or IV. Of these, the Group I, II, and III oils are natural mineral oils. Group I oils are composed of fractionally distilled petroleum which is further refined with solvent extraction processes to improve properties such as oxidation resistance and to remove wax. Group II oils are composed of fractionally distilled petroleum that has been hydrocracked to further refine and purify it. Group III oils have similar characteristics to Group II oils, with Groups II and III both being highly hydro-processed oils which have undergone various steps to improve their physical properties. Group III oils have higher viscosity indexes than Group II oils, and are prepared by either further hydrocracking of Group II oils, or by hydrocracking of hydroisomerized slack wax, which is a byproduct of the dewaxing process used for many of the oils in general. Group IV oils are synthetic hydrocarbon oils, which are also referred to as polyalphaolefins (PAOs). Mixtures of the foregoing oils may be used. Lubricant compositions of the invention preferably contains at least 90 percent of the hydrocarbon base oil, alternatively at least 95 percent, by weight based on the total weight of the hydrocarbon base oil and the polyoxybutylene polymer. In some embodiments, the lubricant compositions contains up to 99 weight percent, alternatively up to 98 weight percent of the hydrocarbon base oil based on the total weight of the hydrocarbon base oil and the polyoxybutylene polymer.

The polyoxybutylene polymer useful herein (also referred to as a BO homopolymer) may be prepared by polymerizing butylene oxide with a monol initiator. Such polymerization processes are known to those skilled in the art (see for instance U.S. Patent publication number 2011/0098492, which is incorporated herein by reference) and suitable polymers are commercially available. In a typical polymerization procedure, the initiator is alkoxylated with butylene oxide in the presence of acidic or alkaline catalysts, or by using metal cyanide catalysts. Alkaline polymerization catalysts may include, for instance, hydroxides or alcoholates of sodium or potassium, including NaOH, KOH, sodium methoxide, potassium methoxide, sodium ethoxide and potassium ethoxide. Base catalysts are typically used in a concentration of from 0.05 percent to about 5 percent by weight, preferably about 0.1 percent to about 1 percent by weight based on starting material.

The addition of butylene oxide may, for instance, be carried out in an autoclave under pressures from about 10 psig to about 200 psig, preferably from about 60 to about 100 psig. The temperature of alkoxylation may range from about 30° C. to about 200° C., preferably from about 100° C. to about 160° C. After completion of oxide feeds, the product is typically allowed to react until the residual oxide is reduced to a desired level, for instance less than about 10 ppm. After cooling the reactor to an appropriate temperature ranging for instance from about 20° C. to 130° C., the residual catalyst may be left unneutralized, or neutralized with organic acids, such as acetic, propionic, or citric acid. Alternatively, the product may be neutralized with inorganic acids, such as phosphoric acid or carbon dioxide. Residual catalyst may also be removed using, for example, ion exchange or an adsorption media, such as diatomaceous earth.

Monol initiators for use in the invention include, for instance, aliphatic alkyl alcohols containing one reactive hydroxyl (OH) group and optionally one or more ether linkages (e.g., glycol ethers such as mono or polyoxyalkylene monoethers. Such compounds are collectively referred to herein as monol initiators. In some embodiments, the monol initiator preferably has from 4 carbon atoms to 22 carbon atoms per molecule. Specific examples include, but are not limited to, butanol, pentanol, hexanol, neopentanol, isobutanol, heptanol, octanol, 2-ethylhexanol, nonanol, decanol, propylene glycol n-butyl ether (available from The Dow Chemical Company as DOWANOL™ PnB), dipropylene glycol n-butyl ether (available from Dow as DOWANOL™ DPnB), and dodecyl alcohol (available e.g., as NACOL® 12-99 from Sasol).

In a preferred embodiment of the invention, the monol initiator is a glycol ether. Examples of preferred glycol ethers include, without limitation, propylene glycol n-butyl ether and dipropylene glycol n-butyl ether. Propylene glycol n-butyl ether is a particularly preferred monol initiator.

Sufficient butylene oxide is used in the polymerization reaction with the initiator to provide a polyoxybutylene polymer having a number average molecular weight ranging from 800 g/mol to 1200 g/mol, alternatively 900 g/mol to 1100 g/mol, alternatively 950 g/mol to 1050 g/mol, or alternatively about 1000 g/mol.

In some embodiments, the polyoxybutylene polymer is included in the lubricant compositions of the invention at a concentration of up to 10 percent by weight, alternatively up to 5 percent by weight, based on the total weight of the hydrocarbon base oil and the polyoxybutylene polymer. In some embodiments, the polyoxybutylene polymer is included in the lubricant compositions at a concentration of at least 1 percent by weight, alternatively at least 2 percent by weight, based on the total weight of the hydrocarbon base oil and the polyoxybutylene polymer. In some embodiments, the lubricant composition comprises from 5 to 10 weight percent of the polyoxybutylene polymer based on the total weight of the hydrocarbon base oil and the polyoxybutylene polymer.

Polyoxybutylene polymers as described herein function as highly effective friction modifier additives for lubricant compositions. Thus, the polyoxybutylene polymers reduce friction between lubricated surfaces relative to a composition free of the polyoxybutylene polymer. In some embodiments, the polyoxybutylene polymers reduce friction between lubricated surfaces by at least 10 percent, alternatively by at least 20 percent, at speeds of 10 and 20 mm/sec relative to a composition free of the polyoxybutylene polymer as measured by a Mini-Traction Machine in which a steel ball (diameter of 19 mm) rotates on a steel disc (diameter of 45 mm) at a slide-roll-ratio of 50% and a contact load of 50N and temperature of 80° C.

Surprisingly, the polyoxybutylene polymers of the invention are significantly more effective friction modifiers than other materials with similar chemical structures and/or molecular weights. For instance, as demonstrated by the examples below, polyoxybutylene polymers prepared from a monol initiator and having a number average molecular weight ranging from 800 to 1200 g/mol, as herein described, significantly outperform polyoxybutylene polymers that are also prepared from a monol initiator but are otherwise of lower or higher molecular weight. In addition, the polyoxybutylene polymers of the invention outperform polyoxybutylene polymers that have very similar molecular weight but that were not prepared from a monol initiator.

Further advantageously, the polyoxybutylene polymers are soluble in hydrocarbon base oils. Moreover, they outperform conventional ester based friction modifiers and also provide the added benefit of having greater hydrolytic stability over the esters, thus making them more stable in the presence of water.

Lubricant compositions of the invention may contain other additives including, for instance, antioxidants, corrosion inhibitors, antiwear additives, foam control agents, yellow metal passivators, dispersants, detergents, extreme pressure additives, additional friction reducing agents, and/or dyes.

The compositions of the invention are useful as lubricants for a variety of mechanical devices including, for example, internal combustion engines such as automotive engines, gear boxes, hydraulic pumps, compressors and transmissions.

Some embodiments of the invention will now be described in detail in the following Examples.

EXAMPLES

The materials in the following Table 1 are used in the example compositions.

TABLE 1

| BASE OIL | Chemistry |
|---|---|
| PO/BO-550 | Dodecanol initiated random copolymer (PO/BO, 50/50 by wt) with a typical kinematic viscosity at 40° C. = 18 $mm^2/s$ (cSt). Its average molecular weight is 550 g/mole. |
| PO/BO-760 | Dodecanol initiated random copolymer (PO/BO, 50/50 by wt) with a typical kinematic viscosity at 40° C. = 32 $mm^2/s$ (cSt). Its average molecular weight is 760 g/mole. |
| PO/BO-1000 | Dodecanol initiated random copolymer (PO/BO, 50/50 by wt) with a typical kinematic viscosity at 40° C. = 46 $mm^2/s$ (cSt). Its average molecular weight is 1000 g/mole. |
| PO/BO-1300 | Dodecanol initiated random copolymer (PO/BO, 50/50 by wt) with a typical kinematic viscosity at 40° C. 68 $mm^2/s$ (cSt). Its average molecular weight is 1300 g/mole. |
| Monol-BO-600 | Propylene glycol n-butyl ether initiated BO homo-polymer with a typical kinematic viscosity at 40° C. of 25 $mm^2/s$ (cSt). Its average molecular weight is 600 g/mole. |
| Monol-BO-1000 | Propylene glycol n-butyl ether initiated BO homo-polymer with a typical kinematic viscosity at 40° C. of 60 $mm^2/s$ (cSt). Its average molecular weight is 1000 g/mole. |
| Monol-BO-2000 | Propylene glycol n-butyl ether initiated BO homo-polymer with a typical kinematic viscosity at 40° C. of 185 $mm^2/s$ (cSt). Its average molecular weight is 2000 g/mole. |
| Diol-BO-1000 | Monopropylene glycol (diol) initiated BO homopolymer with a typical kinematic viscosity at 40° C. = 80 $mm^2/s$ (cSt). Its average molecular weight is 1000 g/mole. |
| SPECTRASYN ™ 8 (available from Exxon Mobil Chemical) | A polyalphaolefin with a typical kinematic viscosity at 100° C. = 8 $mm^2/s$ (cSt). |
| NEXBASE ® 3080 (from Neste) | An API Group III mineral oil with a typical kinematic viscosity at 100° C. = 8 $mm^2/s$ (cSt). |
| SYNATIVE ™ TMTC (from BASF) | Trimethylol propane (TMP) ester of C8/C10 fatty acids with a typical kinematic viscosity at 40° C. (KV40) = 19 cst, KV100 = 4.3 cst and Viscosity index (VI) = 142 (from BASF literature) |
| SYNATIVE ™ ES 2960 (from BASF) | Dibasic acid ester with KV40 = 17.5 cst, KV100 = 4.3 cst and VI = 162 (from BASF literature) |
| SYNATIVE ™ ES DITA (from BASF) | Dibasic acid ester with KV40 = 27.5 cst, KV100 = 5.2 cst and VI = 136 (from BASF literature). The ester is chemically known as Di-(triiso-decyl) adipate |

Method of Measuring Traction (Friction Coefficient)

Friction coefficients are measured using a Mini-Traction Machine (from PCS Instruments) in which a steel ball is rotated on a steel disc. The disc used is steel (AISI 52100), diameter of 45 mm and hardness 750 HV with a Ra<0.02 micrometers. The ball is steel (AISI 52100), diameter of 19 mm and hardness 750 HV with a Ra<0.02 micrometers. Traction coefficients are measured at 80° C. at a slide-roll ratio of 50% and speed 0-2500 mm/s and at a contact load of 37N. Traction values are reported at 5, 10 and 20 mm/sec.

The slide roll ratio, SRR, is the ratio of sliding speed to entrainment speed, i.e.

$$SRR=[U2-U1]/U$$

Where entrainment speed (U) is defined as the mean speed of the two surfaces as follows $$U=\tfrac{1}{2}(U1+U2)$$

Where U1 and U2 are the ball and disc speeds.

The compositions described in Tables 2 and 3 below are prepared by simply adding the ester or oil soluble polyalkylene glycol to the hydrocarbon base oil (either SPECTRASYN™ 8 or NEXBASE® 3080). The mixtures are stirred at ambient temperature until clear and homogeneous.

In the Tables 2 and 3, blends that represent the invention are labeled as "Inv. Ex." Comparative Examples are labeled as "C. Ex."

TABLE 2

Friction data in a representative mineral base oil

| Example (Ex) or Comparative Example (C. Ex) | Composition | 5 mm/sec | 10 mm/sec | 20 mm/sec |
|---|---|---|---|---|
| C. Ex | NEXBASE ® 3080 | 0.111 | 0.094 | 0.074 |
| C. Ex | NEXBASE ® 3080 + PO/BO-550 (10%) | 0.101 | 0.087 | 0.070 |
| C. Ex | NEXBASE ® 3080 + PO/BO-760 (10%) | 0.116 | 0.091 | 0.074 |
| C. Ex | NEXBASE ® 3080 + PO/BO-1000 (10%) | 0.119 | 0.096 | 0.072 |

TABLE 2-continued

Friction data in a representative mineral base oil

| Example (Ex) or Comparative Example (C. Ex) | Composition | 5 mm/sec | 10 mm/sec | 20 mm/sec |
|---|---|---|---|---|
| C. Ex | NEXBASE ® 3080 + PO/BO-1300 (10%) | 0.097 | 0.080 | 0.065 |
| C. Ex | NEXBASE ® 3080 + Monol-BO-600 (10%) | 0.104 | 0.086 | 0.074 |
| Ex | NEXBASE ® 3080 + Monol-BO-1000 (10%) | 0.084 | 0.068 | 0.058 |
| C. Ex | NEXBASE ® 3080 + Monol-BO-2000 (10%) | 0.098 | 0.087 | 0.069 |
| C. Ex | NEXBASE ® 3080 + Diol-BO-1000 (10%) | 0.093 | 0.093 | 0.070 |
| C. Ex | NEXBASE ® 3080 + PO/BO-550 (5%) | 0.099 | 0.088 | 0.074 |
| C. Ex | NEXBASE ® 3080 + PO/BO-1300 (5%) | 0.108 | 0.091 | 0.080 |
| Ex | NEXBASE ® 3080 + Monol-BO-1000 (5%) | 0.075 | 0.055 | 0.046 |
| C. Ex | NEXBASE ® 3080 + SYNATIVE ™ DITA (10%) | 0.097 | 0.083 | 0.071 |
| C. Ex | NEXBASE ® 3080 + SYNATIVE ™ 2960 (10%) | 0.101 | 0.086 | 0.075 |
| C. Ex | NEXBASE ® 3080 + SYNATIVE ™ TMTC (10%) | 0.086 | 0.082 | 0.072 |

TABLE 3

Friction data in a representative polyalphaolefin base oil

| Example (EX) or Comparative Example (C. Ex) | Composition | 5 mm/sec | 10 mm/sec | 20 mm/sec |
|---|---|---|---|---|
| C. Ex | SPECTRASYN ™ 8 | 0.113 | 0.097 | 0.075 |
| C. Ex | SPECTRASYN ™ 8 + PO/BO-550 (10%) | 0.122 | 0.103 | 0.086 |
| C. Ex | SPECTRASYN ™ 8 + PO/BO-760 (10%) | 0.109 | 0.087 | 0.069 |
| C. Ex | SPECTRASYN ™ 8 + PO/BO-1000 (10%) | 0.116 | 0.085 | 0.070 |
| C. Ex | SPECTRASYN ™ 8 + PO/BO-1300 (10%) | 0.100 | 0.090 | 0.071 |
| C. Ex | SPECTRASYN ™ 8 + Monol-BO-600 (10%) | 0.122 | 0.091 | 0.078 |
| Ex | SPECTRASYN ™ 8 + Monol-BO-1000 (10%) | 0.076 | 0.070 | 0.057 |
| C. Ex | SPECTRASYN ™ 8 + Monol-BO-2000 (10%) | 0.101 | 0.087 | 0.069 |
| C. Ex | SPECTRASYN ™ 8 + Diol-BO-1000 (10%) | 0.123 | 0.104 | 0.087 |
| C. Ex | SPECTRASYN ™ 8 + PO/BO-550 (5%) | 0.085 | 0.074 | 0.057 |
| C. Ex | SPECTRASYN ™ 8 + PO/BO-1300 (5%) | 0.102 | 0.080 | 0.066 |
| Ex | SPECTRASYN ™ 8 + Monol-BO-1000 (5%) | 0.076 | 0.065 | 0.053 |
| C. Ex | SPECTRASYN ™ 8 + SYNATIVE ™ DITA (10%) | 0.096 | 0.088 | 0.068 |
| C. Ex | SPECTRASYN ™ 8 + SYNATIVE ™ 2960 (10%) | 0.104 | 0.084 | 0.068 |
| C. Ex | SPECTRASYN ™ 8 + SYNATIVE ™ TMTC (10%) | 0.087 | 0.078 | 0.060 |

In Tables 2 and 3 friction values are reported at three different speeds (5, 10 and 20 mm/sec). These speeds represent friction in the boundary region of the classical Stribeck curves. NEXBASE® 3080 and SPECTRASYN™ 8 are used as representative hydrocarbon base oils.

SYNATIVE™ 2960 and DITA (both dicarboxylic acid esters) and SYNATIVE™ TMTC (TMP polyol ester) have been used as friction reducers in hydrocarbon oils for many years. TMP polyol esters are considered to be more favorable but are more expensive. Friction reducers that can provide lower values than these benchmark products are desired. For example friction reducers that offer friction coefficients <0.078 at a speed of 10 mm/sec are desired.

Tables 2 and 3 show data for three different chemical families of oil soluble polymers. Firstly, the propylene oxide/butylene oxide (PO/BO) derived series—these are alcohol (dodecanol) initiated PO/BO (50/50 w/w) random co-polymers. Secondly, the monol-BO based series—these are propylene glycol n-butyl ether initiated (butanol+1 PO) homo-polymers of BO. And thirdly the diol-BO based material (this is an example of a diol initiated BO homo-polymer).

The data in Tables 2 and 3 shows that the inventive Monol-BO-1000 is clearly differentiated versus the other materials in hydrocarbon base oils and exhibits lower friction values.

Surprisingly the inventive Monol-BO-1000, and the comparative PO/BO-1300 and Diol-BO-1000 are polymers that have similar viscosities and molecular weights but differ in the polymer architecture and their friction performance. Diol-BO-1000 shows no significant friction reducing behavior in NEXBASE® 3080 or SPECTRASYN™ 8 at a treat level of 10%. PO/BO-1300 shows a mild effect at a treat level of 10%. This polymer has a long chain linear tail (C12) and a mixed PO/BO tail. Inventive Monol-BO-1000 shows a significant friction reducing effect in NEXBASE® 3080 and SPECTRASYN™ 8. Furthermore Monol-BO-600 and Monol-BO-2000, which are lower and higher molecular weight polymers of this family did not exhibit the same friction reducing property.

Figure 2:
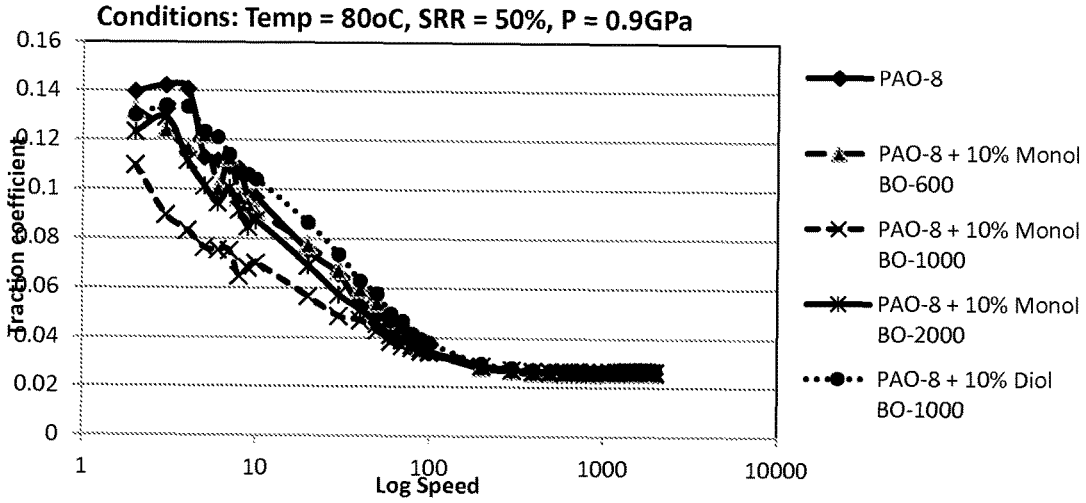
FIG. 2 shows friction profiles for various comparative and inventive polymers in a representative polyalphaolefin hydrocarbon base oil (SPECTRASYN™ 8).

FIGS. 1 and 2 illustrate friction profiles for various comparative and inventive polymers in the Mini-Traction machine experiments. At speeds of <50 mm/sec boundary friction can occur and friction reducer additives can be examined for their behavior. As is apparent from the FIGs, the inventive Monol-BO-1000 material exhibits a more favorable friction profile than the comparative materials.

The invention claimed is:

1. A lubricant composition comprising:

a hydrocarbon based oil; and a polyoxybutylene polymer friction modifier a polyoxybutylene polymer friction modifier having a number average molecular weight having a number average molecular weight ranging from 800 g/mol and 1200 g/mol, the polyoxybutylene polymer friction modifier further characterized as being a propylene glycol n-butyl ether initiated butylene oxide homo-polymer having a kinematic viscosity at 40 degrees Celsius of 60 centiStokes and wherein the polyoxybutylene polymer friction modifier comprises from 1 weight percent to 10 weight percent of the total weight of the hydrocarbon based oil and the polyoxybutylene polymer friction modifier.

2. A method for reducing friction between lubricated surfaces, the method comprising: lubricating a surface with the lubricant composition of claim 1, wherein friction is reduced relative to a composition free of the polyoxybutylene polymer friction modifier.

3. A method of lubricating a mechanical device, the method comprising using the lubricant composition of claim 1 to lubricate the mechanical device.

4. The lubricant of claim 1 wherein the polyoxybutylene polymer friction modifier is a propylene glycol n-butyl ether initiated butylene oxide homo-polymer with a kinematic viscosity at 40 degrees Celsius of 60 centiStokes and a number average molecular weight of 1000 grams per mole.

5. The lubricant of claim 1, further comprising from 5 weight percent to 10 weight percent of the polyoxybutylene polymer friction modifier based on the total weight of the hydrocarbon based oil and the polyoxybutylene polymer friction modifier.

* * * * *